US010577813B2

(12) United States Patent
Dahill

(10) Patent No.: US 10,577,813 B2
(45) Date of Patent: Mar. 3, 2020

(54) TILE LEVELING DEVICE

(71) Applicant: TTI (MACAO COMMERCIAL OFFSHORE) LIMITED, Macau (MO)

(72) Inventor: Drew A. Dahill, Pendleton, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 0 days.

(21) Appl. No.: 15/891,686

(22) Filed: Feb. 8, 2018

(65) Prior Publication Data

US 2019/0242143 A1 Aug. 8, 2019

(51) Int. Cl.

| | |
|---|---|
| ***E04D 15/00*** | (2006.01) |
| ***E04F 21/22*** | (2006.01) |
| ***E04F 21/00*** | (2006.01) |

(52) U.S. Cl.

CPC ..... *E04F 21/22* (2013.01); *E04F 21/0092* (2013.01)

(58) Field of Classification Search

CPC ..... E04F 21/22; E04F 21/0092
USPC ..... 52/749.11
See application file for complete search history.

(56) References Cited

U.S. PATENT DOCUMENTS

| | | | | |
|---|---|---|---|---|
| 4,397,125 | A * | 8/1983 | Gussler, Jr. | E04F 21/0092 52/127.3 |
| 5,603,195 | A | 2/1997 | Cosentino | |
| 7,257,926 | B1 | 8/2007 | Kirby | |
| 7,621,100 | B2 | 11/2009 | Kufner et al. | |
| 7,861,487 | B2 | 1/2011 | Kufner et al. | |
| 7,946,093 | B1 | 5/2011 | Sturino | |
| 7,954,300 | B1 | 6/2011 | Kufner et al. | |
| 7,992,354 | B2 | 8/2011 | Doda, Jr. | |
| 8,011,164 | B2 | 9/2011 | Kufner et al. | |
| 8,079,199 | B1 | 12/2011 | Kufner et al. | |
| 8,099,926 | B2 | 1/2012 | Kufner et al. | |
| 8,181,420 | B2 | 5/2012 | Torrents I Comas | |
| 8,336,279 | B2 | 12/2012 | Kufner et al. | |
| D678,039 | S | 3/2013 | Psaila | |
| 8,429,878 | B1 | 4/2013 | Hoffman et al. | |
| 8,429,879 | B1 | 4/2013 | Hoffman et al. | |
| 8,561,370 | B1 | 10/2013 | Hoffman et al. | |
| 8,572,927 | B1 | 11/2013 | Hoffman et al. | |
| 8,607,530 | B2 | 12/2013 | Hoffman et al. | |
| 8,635,815 | B2 | 1/2014 | Bordin | |
| 8,671,628 | B2 | 3/2014 | Sighinolfi | |

(Continued)

FOREIGN PATENT DOCUMENTS

| | | | |
|---|---|---|---|
| BR | 102014010232-9 | A2 | 2/2016 |
| CA | 2909720 | A1 | 12/2016 |

(Continued)

OTHER PUBLICATIONS

European Patent Office Search Report for Application No. 19155979.8, dated May 14, 2019, 12 pages.

*Primary Examiner* — Basil S Katcheves
(74) *Attorney, Agent, or Firm* — Michael Best & Friedrich LLP

(57) ABSTRACT

According to one embodiment, the tile leveling device includes a base having a top surface and a bottom surface. The base includes a projection extending upwardly from the top surface. The tile leveling device further includes a stem detachably coupled to the top surface of the base. The stem includes a lower portion and an upper portion having a threaded portion. The lower portion is wider than the upper portion.

18 Claims, 17 Drawing Sheets

(56) References Cited

U.S. PATENT DOCUMENTS

| | | | | |
|---|---|---|---|---|
| 8,689,521 | B1 | 4/2014 | Hoffman et al. | |
| 8,689,522 | B2 | 4/2014 | Hoffman et al. | |
| 8,800,246 | B2 | 8/2014 | Gorton | |
| 8,820,031 | B2 | 9/2014 | Kufner et al. | |
| 8,887,475 | B2 | 11/2014 | Ghelfi | |
| 8,966,835 | B1 | 3/2015 | Hoffman et al. | |
| 9,027,308 | B2 | 3/2015 | Kufner et al. | |
| 9,010,064 | B1 | 4/2015 | Farahmandpour | |
| 9,045,911 | B2 | 6/2015 | Hoffman et al. | |
| 9,097,026 | B2 | 8/2015 | Hoffman et al. | |
| D742,719 | S | 11/2015 | Komura et al. | |
| 9,228,363 | B2 | 1/2016 | Kufner et al. | |
| 9,260,855 | B2 | 2/2016 | Farahmandpour | |
| 9,260,872 | B2 | 2/2016 | Bunch | |
| 9,267,298 | B2 | 2/2016 | Kufner et al. | |
| 9,279,259 | B1 | 3/2016 | Russo | |
| 9,322,185 | B1 | 4/2016 | Russo | |
| 9,322,186 | B1 | 4/2016 | Chang et al. | |
| 9,328,522 | B2 | 5/2016 | Bordin | |
| 9,464,448 | B2 | 10/2016 | Hoffman et al. | |
| 9,470,002 | B2 | 10/2016 | Irvine et al. | |
| 9,470,003 | B1 | 10/2016 | Moon | |
| 9,482,018 | B2 * | 11/2016 | Torrents I Comas ... | E04F 21/22 |
| 9,482,019 | B2 | 11/2016 | Fontana | |
| 9,487,959 | B2 | 11/2016 | Bunch et al. | |
| D775,935 | S | 1/2017 | Sarajian et al. | |
| D778,709 | S | 2/2017 | Russo | |
| 9,657,485 | B2 | 5/2017 | Meyers | |
| D792,250 | S | 7/2017 | Hill | |
| D830,161 | S | 10/2018 | Russo | |
| D831,459 | S | 10/2018 | Cartwright | |
| D834,922 | S | 12/2018 | Russo | |
| 2006/0185269 | A1 | 8/2006 | Kufner et al. | |
| 2009/0126213 | A1 | 5/2009 | Tavy et al. | |
| 2010/0263304 | A1 * | 10/2010 | Torrents I Comas ..... | E04F 21/0092 52/126.5 |
| 2010/0287868 | A1 * | 11/2010 | Kufner ..... | E04F 21/0092 52/391 |
| 2013/0067854 | A1 | 3/2013 | Bordin | |
| 2013/0255182 | A1 * | 10/2013 | Kufner ..... | E04F 21/22 52/749.11 |
| 2014/0116001 | A1 * | 5/2014 | Ghelfi ..... | E04F 21/22 52/749.11 |
| 2014/0325936 | A1 | 11/2014 | Psaila et al. | |
| 2015/0211243 | A1 * | 7/2015 | Irvine ..... | E04F 21/0092 52/126.1 |
| 2015/0240504 | A1 | 8/2015 | Hoffman et al. | |
| 2015/0267420 | A1 | 9/2015 | Fontana | |
| 2016/0108627 | A1 | 4/2016 | Kufner et al. | |
| 2016/0186449 | A1 | 6/2016 | Lee | |
| 2016/0376795 | A1 | 12/2016 | Irvine et al. | |
| 2017/0009464 | A1 | 1/2017 | Hoffman et al. | |
| 2017/0009465 | A1 | 1/2017 | Volponi | |

FOREIGN PATENT DOCUMENTS

| | | | |
|---|---|---|---|
| EP | 2241702 | A2 | 10/2010 |
| EP | 2966238 | A1 | 1/2016 |
| WO | 2016135354 | A1 | 9/2016 |

* cited by examiner

TILE LEVELING DEVICE

FIELD OF THE INVENTION

The present invention relates to tile leveling devices.

BACKGROUND OF THE INVENTION

Tiles are often secured to a substrate such as a floor, wall, countertop, or the like using grout/mortar located underneath the tiles and between the tiles. When tiles are being installed, it is often desirable that adjacent tiles are laid in a manner such that top surfaces of the adjacent tiles are level with each other.

SUMMARY OF THE INVENTION

In one embodiment, a tile leveling device is provided for use when installing tiles on a substrate such as a floor, wall, countertop, or the like. In some embodiments, the tile leveling and aligning device is used to ensure that adjacent tiles being laid on a surface are level with each other and are properly aligned with each other.

In one embodiment, a tile leveling device is provided. The tile leveling device includes a base having a top surface and a bottom surface. The base includes a projection extending upwardly from the top surface. The tile leveling device further includes a stem detachably coupled to the top surface of the base. The stem includes a lower portion and an upper portion having a threaded portion. The lower portion is wider than the upper portion.

In another embodiment, another tile leveling device is provided. The tile leveling device includes a base member and a top member. The base member includes a base having a top surface, a bottom surface, a first end, a second end, and a projection extending from the top surface. The bottom surface contacts a substrate during use, and the top surface is configured to support at least one tile during use. The base member further includes a stem detachably coupled to the top surface of the base. The stem includes a lower portion and an upper portion. The lower portion of the stem has a width greater than the upper portion of the stem. The upper portion of the stem includes a threaded portion to receive the top member. The stem includes an opening positioned at a center of the lower portion of the stem. A longitudinal axis passes through the first end of the base, the opening, and the second end of the base, and the projection is positioned along the longitudinal axis substantially perpendicular to the lower portion of the stem. The base has a variable thickness, with the thickness greater at a central portion of the base and the thickness lesser at the first and second ends of the base.

In another embodiment, another tile leveling device is provided. The tile leveling device includes a base member including a base having a top surface and a first bottom surface. The base includes a projection extending upwardly from the top surface. The base member further includes a stem detachably coupled to the top surface of the base. The stem includes a lower portion and an upper portion. The lower portion is wider than the upper portion, and the upper portion of the stem includes a threaded portion. The stem includes an opening located at a center of the lower portion of the stem, and the projection is positioned substantially perpendicular to the lower portion of the stem. The tile leveling device further includes a top member including a hub defining a threaded bore that threadably couples with the upper portion of the stem, and a second bottom surface Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION OF THE DRAWINGS

Figure 1A:
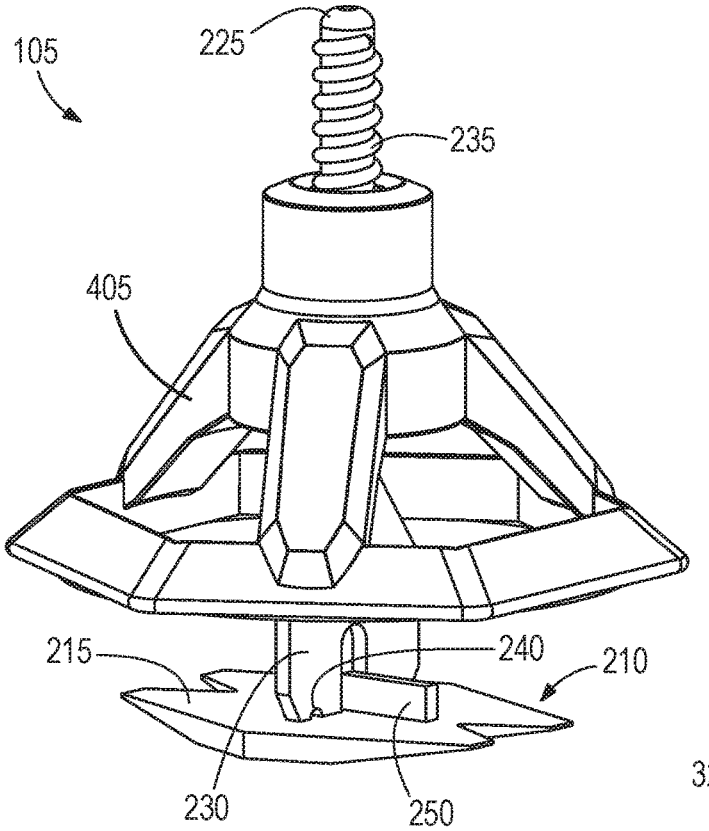
FIG. 1A is a perspective view of a tile leveling device according to one embodiment of the invention.
Figure 1B:
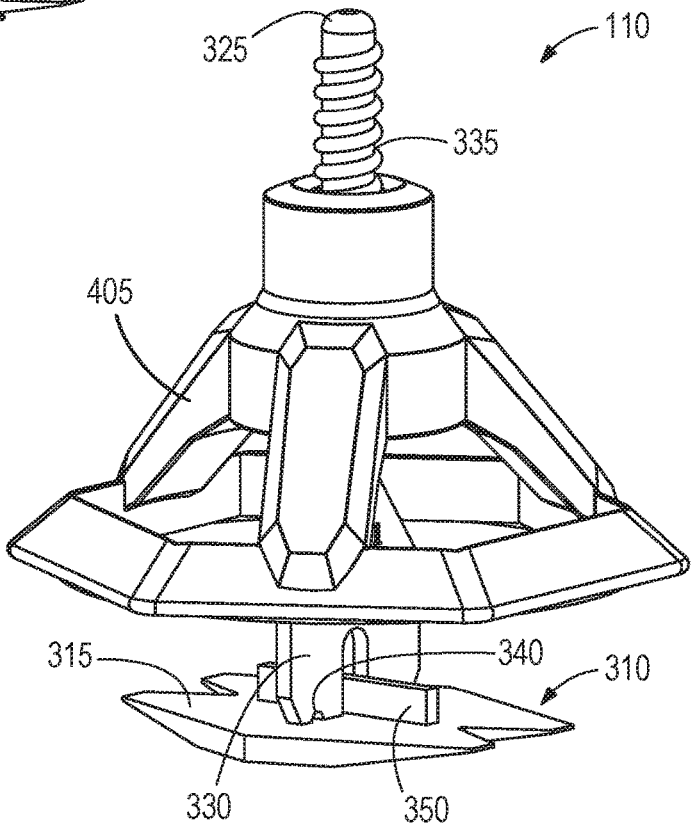
FIG. 1B is a perspective view of a tile leveling device according to another embodiment of the invention.

Tile leveling devices or systems 105 and 110, as shown in FIGS. 1A and 1B, are used to align and level adjacent tiles being laid on a support surface. Most tile leveling systems includes at least a first, base or aligning member, which is placed on a support surface and under adjacent tiles, and second, top or leveling member, which is supported on the base member and placed above the tiles. FIGS. 2A-2F illustrate various views of a base member 205 of the tile leveling device 105 of FIG. 1A. The tile leveling device 105 includes a top member 405 (FIGS. 4A and 4B) that interacts with the base member 205 to level and align tiles as described in greater detail below. In some embodiments, the base member 205 is made of plastic and at least some parts of the base member 205 may be disposed of after being used (e.g., stem 225).

Figure 2B:
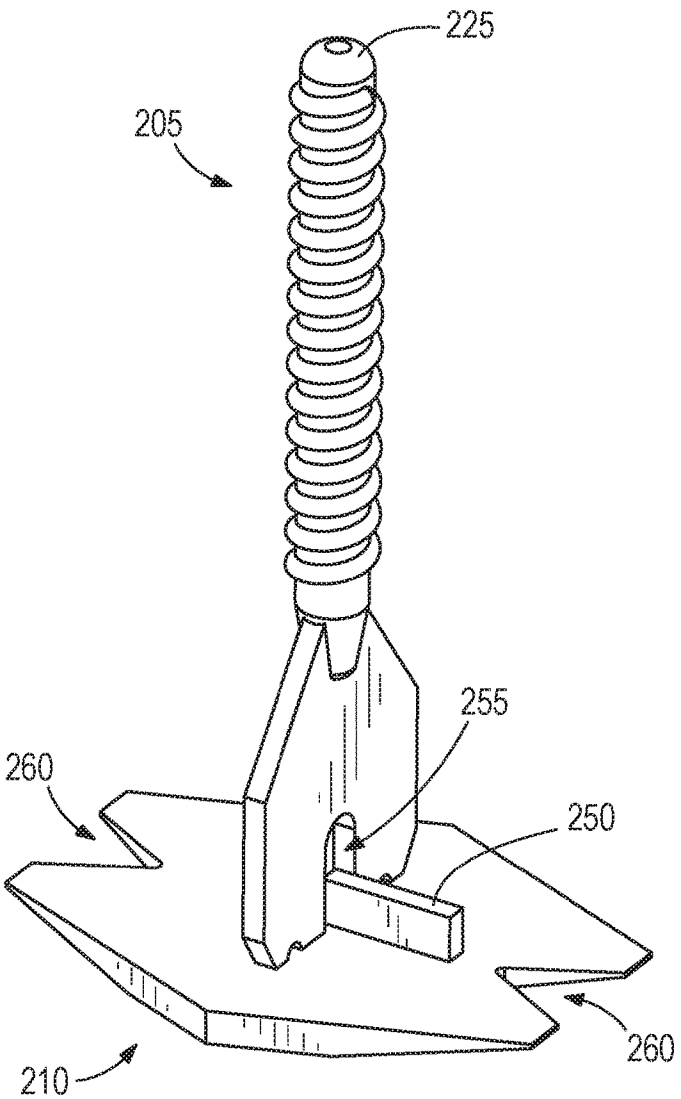
FIG. 2B is a top-back perspective view of the base member of the tile leveling device of FIG. 1A.
Figure 2A:
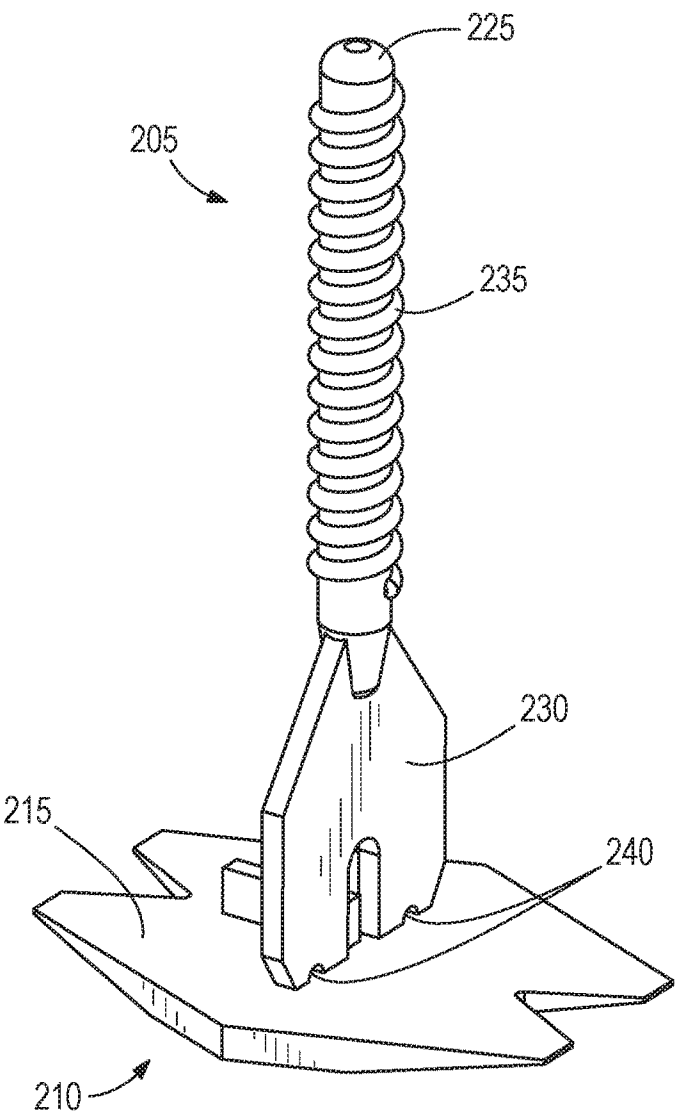
FIG. 2A is a top-front perspective view of a base member of the tile leveling device of FIG. 1A.
Figure 2E:
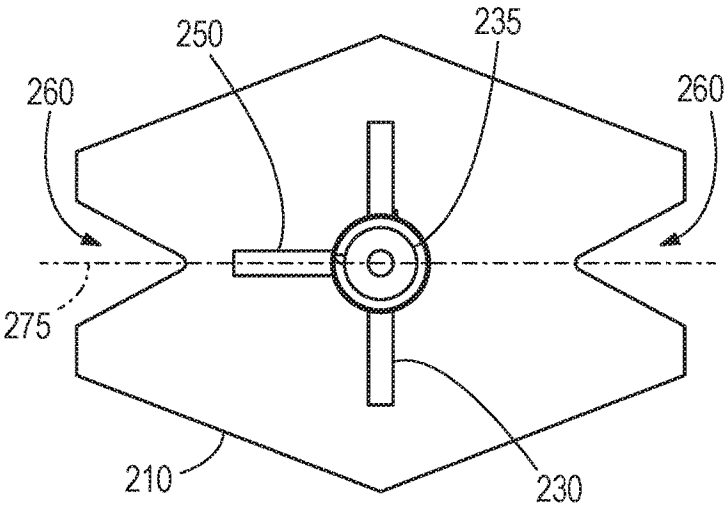
FIG. 2E is a top view of the base member of the tile leveling device of FIG. 1A.
Figure 2D:
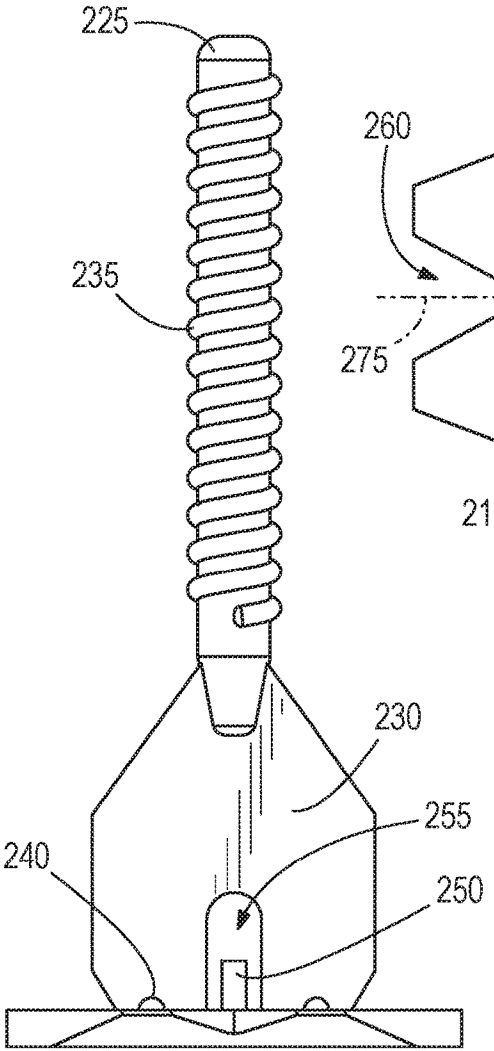
FIG. 2D is a front view of the base member of the tile leveling device of FIG. 1A.
Figure 2C:
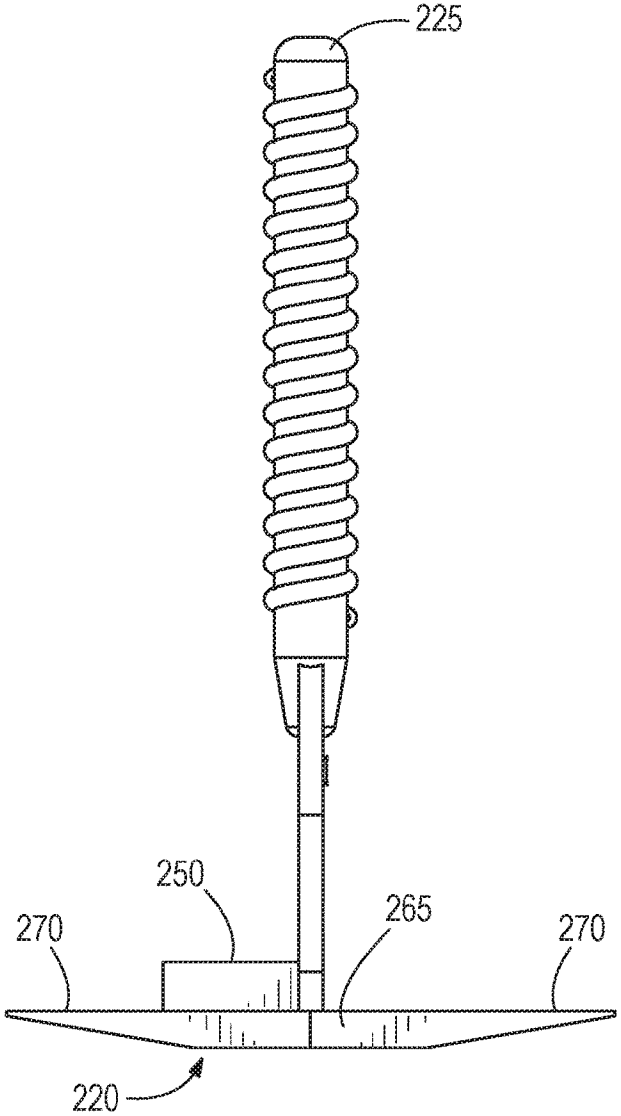
FIG. 2C is a side view of the base member of the tile leveling device of FIG. 1A.

As shown in FIGS. 2A and 2C, the base member 205 includes a base 210 having a top surface 215 and a bottom surface 220. The bottom surface 220 contacts a substrate on which tiles are placed (e.g., a floor, wall, countertop, or the like). The top surface 215 contacts a bottom surface of tiles 280 that are placed on the base 210 (e.g., see FIG. 2F that shows the tiles 280 in broken lines).

The base member 205 also includes a stem 225 coupled to the top surface 215 of the base 210. As shown in FIG. 2A, the stem 225 includes a lower portion 230 and an upper portion 235. The upper portion 235 of the stem 225 includes a threaded portion that threadably couples with corresponding threads on the top member 405 (see, e.g., threads 415 of FIGS. 4A and 4B).

In the illustrated embodiment, the lower portion 230 of the stem 225 is wider than the upper portion 235 of the stem 225. The lower portion 230 of the stem 225 also includes a weakened portion 240 at an intersection of the stem 225 and the base 210 that allows the stem 225 to be removed from the base 210 when a force is applied to the stem 225. That is, the stem 225 is detachably coupled to the top surface 215 of the base 210 at the lower portion 230 to allow for easy removal of the stem 225 from the base 210.

For example, after the tile leveling device has been used to level and align tiles and grout/mortar securing the tiles to the substrate has dried, the stem 225 may be removed from the base 210 by applying a force to the stem 225. In some embodiments, the base 210 remains underneath the tiles after the stem 225 is removed from the base 210. In the illustrated embodiment, the weakened portion 240 includes one or more holes to weaken the structural integrity of the intersection between the base 210 and the lower portion 230 of the stem 225. In other embodiments, the weakened portion 240 is thinner than the rest of the lower portion 230 of the stem 225 to weaken the structural integrity of the intersection between the base 210 and the lower portion 230 of the stem 225.

Figure 2F:
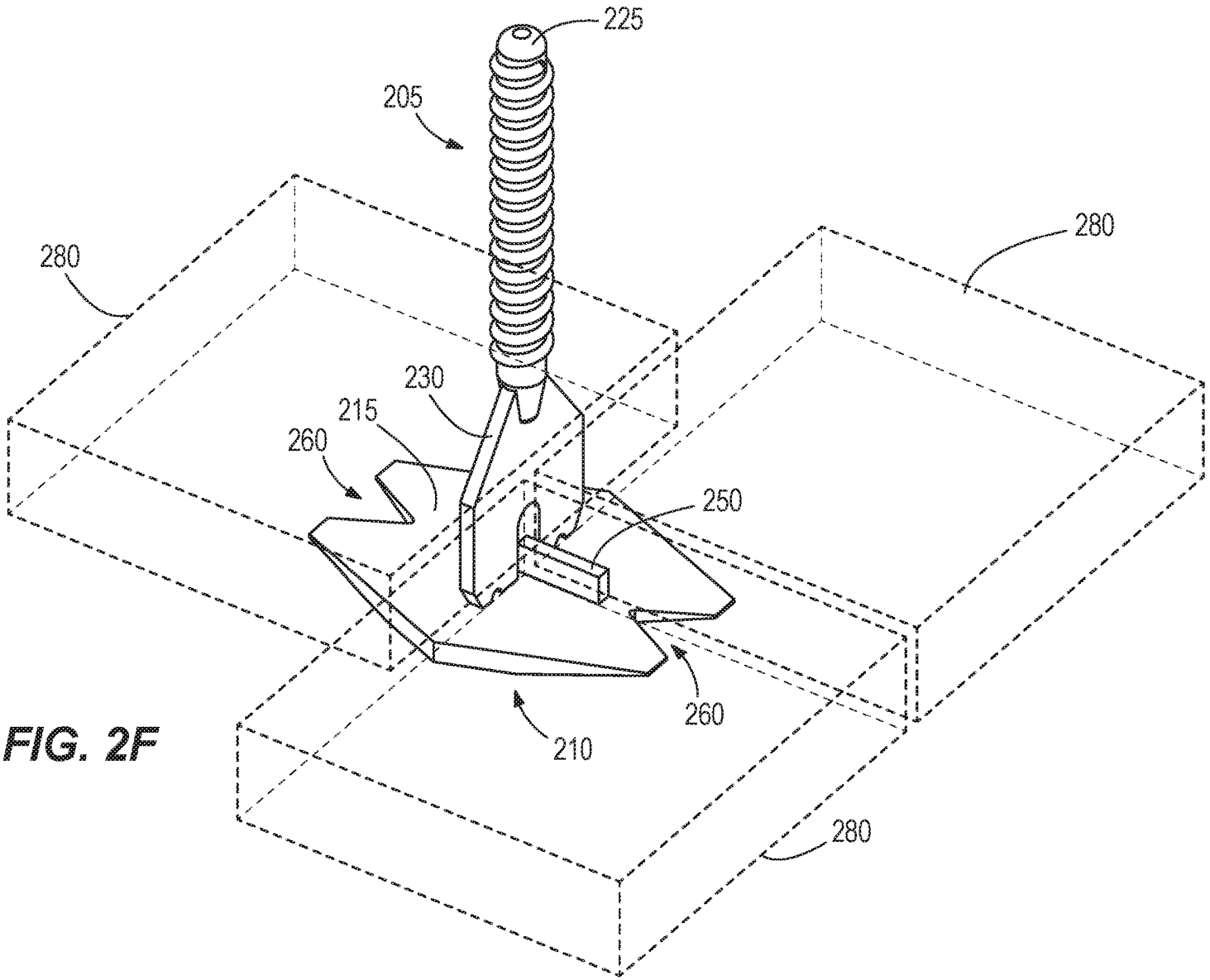
FIG. 2F is a top-back perspective view of the base member of the tile leveling device of FIG. 1A that shows the base member in use with tiles placed on the base member.

As shown in FIG. 2B, the base 210 includes a projection 250 that extends upwardly from the top surface 215 of the base 210 and acts as a tile spacer. The projection 250 and the lower portion 230 of the stem 225 are configured to maintain spacing between the tiles 280 placed on the top surface 215 of the base 210. As shown in FIG. 2F, the projection 250 and the lower portion 230 of the stem 225 maintain spacing for three tiles 280 placed on the base 210. For example, the projection 250 maintains spacing between two tiles 280, the edges of which are placed on the base 210. Similarly, the lower portion 230 of the stem 225 maintains spacing between a third tile 280 that is placed on the base 210 and the first two tiles 280.

As shown in FIGS. 2B and 2D, in the illustrated embodiment, the stem 225 includes an opening 255 located at a center of the lower portion 230 of the stem 225. A portion of the projection 250 is positioned within the opening 255. For example, as shown in FIGS. 2B and 2D, an end of the projection 250 is positioned within the opening 255. In other embodiments, the projection 250 passes through the opening 255 (for example, see projection 350 and opening 355 shown in FIGS. 3A-3F) or is positioned on one side of the opening 255 without a portion of the projection 250 being positioned within the opening 255. In embodiments where the projection 250 passes through the opening 255, the projection 250 and the lower portion 230 of the stem 225 are configured to maintain spacing between four tiles 380, the edges of which are placed on the base 210 (see FIG. 3F).

As shown in FIGS. 2B and 2E, the base 210 includes cutouts 260 on each end of the base 210. In other words, the base 210 includes a first cutout 260 at a first end of the base 210 with respect to the stem 225 and a second cutout 260 at a second end of the base 210 with respect to the stem 225. In some embodiments, the cutouts 260 are triangularly-shaped as shown in FIG. 2E. As shown in FIG. 2C, in some embodiments, a thickness of the base 210 is greater at a central or middle portion 265 of the base 210 where the stem 225 is located than at the first and second ends of the base 210 (i.e., outer portions 270 of the base 210 where the cutouts 260 are located). In other words, a first thickness at the central portion 265 of the base 210 where the stem 225 is located is greater than a second thickness at outer portions 270 of the base 210 where the cutouts 260 are located. The cutouts 260, the opening 255, and the variable thickness of the base 210 allow grout/mortar to disperse during installation of tiles. As shown in FIG. 2E, a longitudinal axis 275 of the base 210 passes through the cutouts 260, the opening 255, and the projection 250. In other words, the longitudinal axis 275 passes through the first end of the base 210, the opening 255, and the second end of the base 210. As shown in FIG. 2E, the projection 250 is positioned along the longitudinal axis 275 and substantially perpendicular to the lower portion 230 of the stem 225. In some embodiments, two components are substantially perpendicular when they are within five or less degrees of being perpendicular or within ten or less degrees of being perpendicular.

FIGS. 3A-3F illustrate various views of a base member 305 of the tile leveling device 110 of FIG. 1B. Like the base member 205 described above, the base member 305 interacts with the top member 405 (FIGS. 4A and 4B) to form the tile leveling device 110 that levels and aligns tiles. The base member 305 is similar to the base member 205 described above, and common elements have the same reference number plus "100". The above explanation of the elements of the base member 205 applies to the common elements of the base member 305, unless otherwise noted.

Figure 3B:
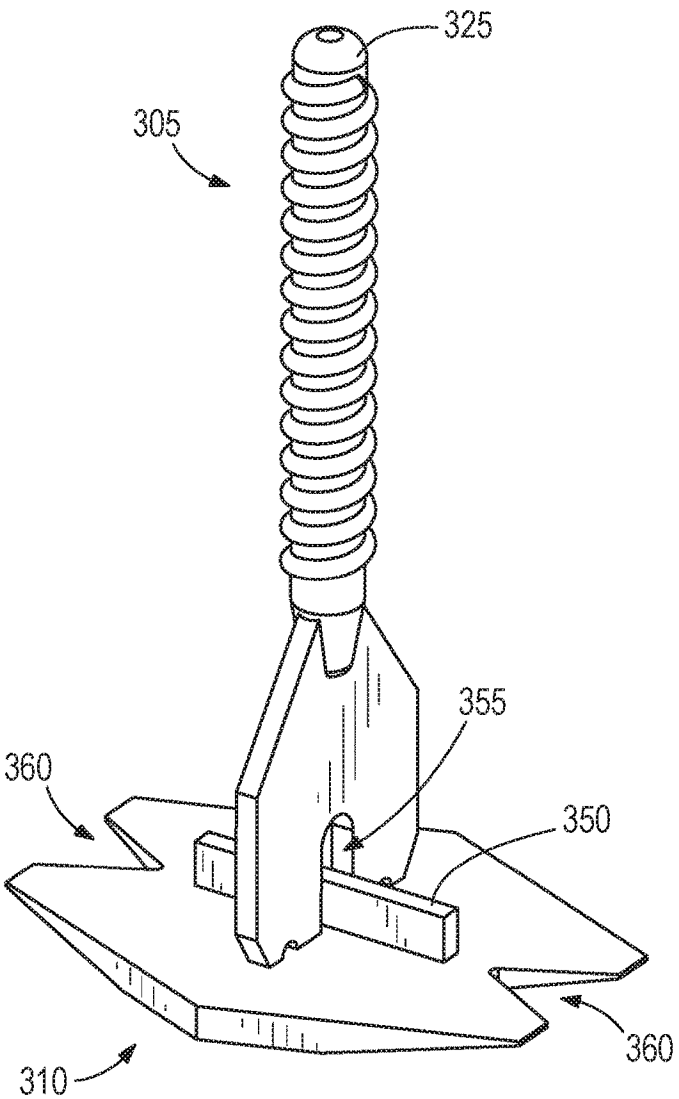
FIG. 3B is a top-back perspective view of the base member of the tile leveling device of FIG. 1B.
Figure 3A:
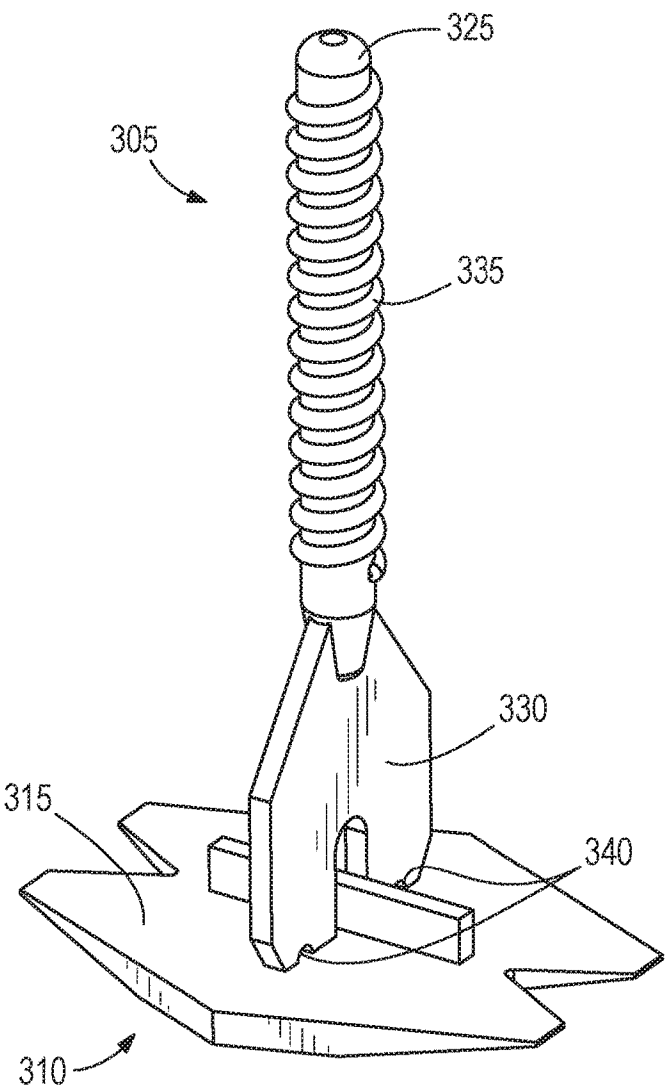
FIG. 3A is a top-front perspective view of a base member of the tile leveling device of FIG. 1B.
Figure 3E:
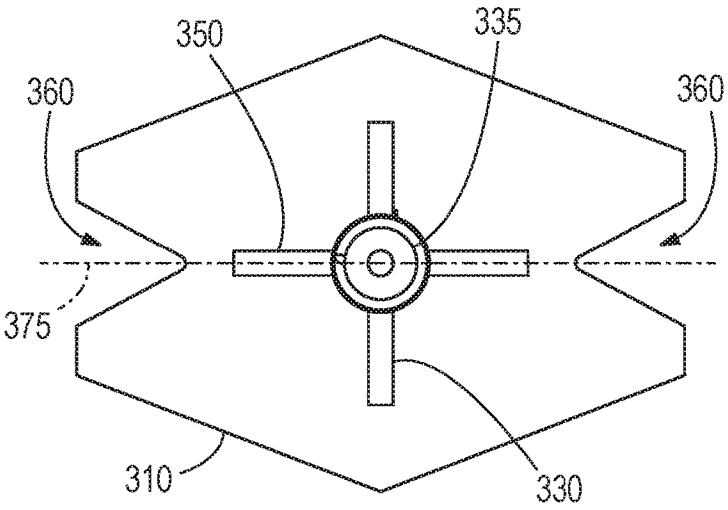
FIG. 3E is a top view of the base member of the tile leveling device of FIG. 1B.
Figure 3D:
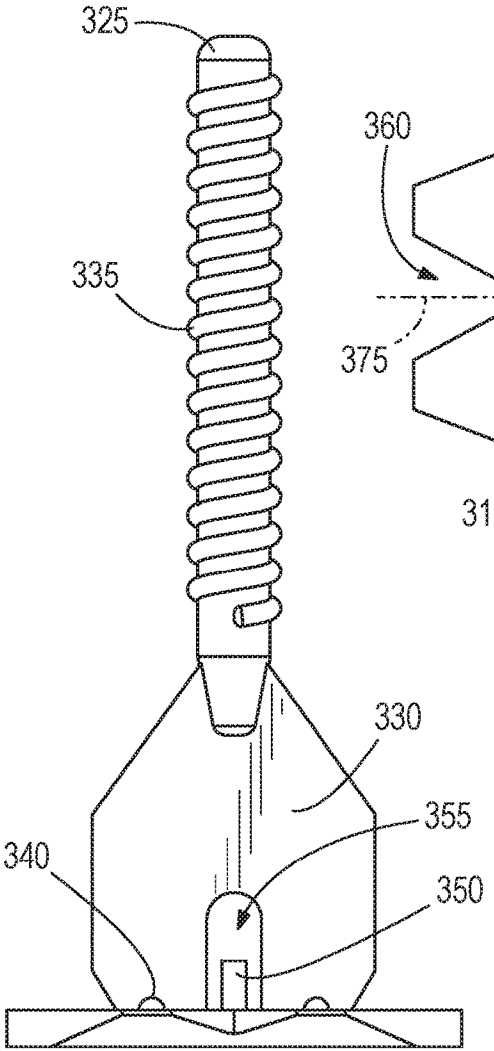
FIG. 3D is a front view of the base member of the tile leveling device of FIG. 1B.
Figure 3C:
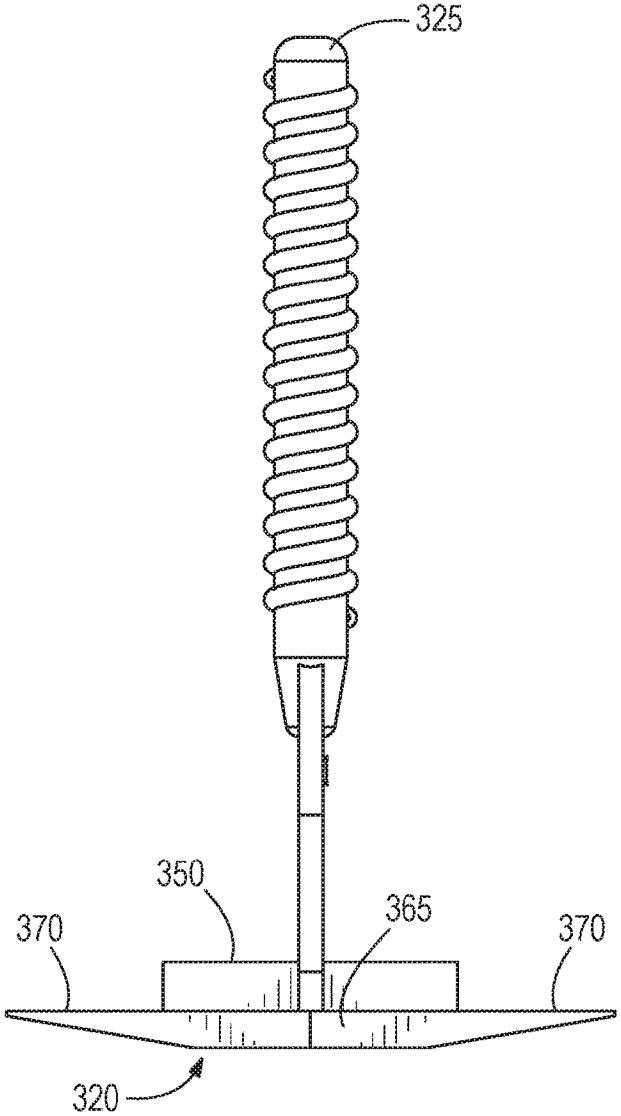
FIG. 3C is a side view of the base member of the tile leveling device of FIG. 1B.

As shown in FIGS. 3A and 3C, the base member 305 includes a base 310 having a top surface 315 and a bottom surface 320. The base member 305 also includes a stem 325 coupled to the top surface 315 of the base 310. As shown in FIG. 3A, the stem 325 includes a lower portion 330 and an upper portion 335. The lower portion 330 of the stem 325 includes a weakened portion 340 at an intersection of the stem 325 and the base 310 that allows the stem 325 to be removed from the base 310 when a force is applied to the stem 325 as explained above with respect to weakened portion 240.

Figure 3F:
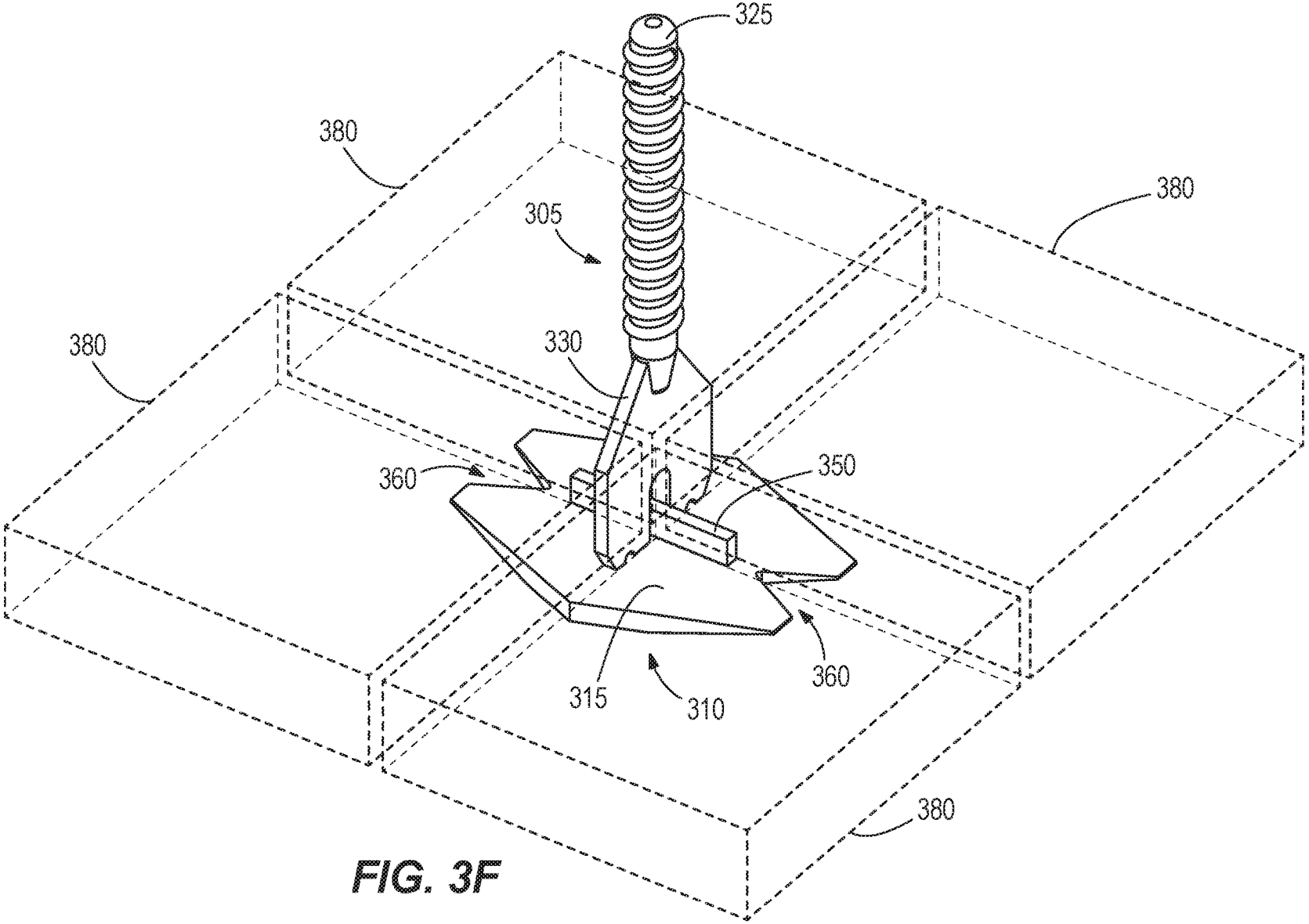
FIG. 3F is a top-back perspective view of the base member of the tile leveling device of FIG. 1B that shows the base member in use with tiles placed on the base member.

As shown in FIG. 3B, the base 310 includes a projection 350 that extends upwardly from the top surface 315 of the base 310 and acts as a tile spacer. As shown in FIGS. 3B and 3D, the stem 325 includes an opening 355 located at a center of the lower portion 330 of the stem 325. In the illustrated embodiment, the projection 350 passes through the opening 355, as shown in FIGS. 3A and 3B. As shown in FIG. 3F, the projection 350 and the lower portion 330 of the stem 325 are configured to maintain spacing between four tiles 380 placed on the top surface 315 of the base 310. For example, the top view of the base member 305 shown in FIG. 3E shows that the projection 350 and the lower portion 330 of the stem 325 form a cross with four quadrants. A corner of each of four different tiles 380 may be placed on the base 310 in the four quadrants against each of the edges of the cross to maintain spacing between the four tiles 380 (see FIG. 3F).

As shown in FIGS. 3B and 3E, the base 310 includes cutouts 360 on each end of the base 310. In other words, the base 310 includes a first cutout 360 at a first end of the base 310 with respect to the stem 325 and a second cutout 360 at a second end of the base 310 with respect to the stem 325. In some embodiments, the cutouts 360 are triangularly-shaped as shown in FIG. 3E. As shown in FIG. 3C, in some embodiments, a thickness of the base 310 is greater at a central or middle portion 365 of the base 310 where the stem 325 is located than at the first and second ends of the base 310 (i.e., outer portions 370 of the base 310 where the cutouts 360 are located). In other words, a first thickness at the middle portion 365 of the base 310 where the stem 325 is located is greater than a second thickness at outer portions 370 of the base 310 where the cutouts 360 are located. As shown in FIG. 3E, a longitudinal axis 375 of the base 310 passes through the cutouts 360, the opening 355, and the projection 350. In other words, the longitudinal axis 375 passes through the first end of the base 310, the opening 355, and the second end of the base 310. As shown in FIG. 3E, the projection 350 is positioned along the longitudinal axis 375 substantially perpendicular to the lower portion 330 of the stem 325. In some embodiments, two components are substantially perpendicular when they are within five or less degrees of being perpendicular or within ten or less degrees of being perpendicular.

Figure 4B:
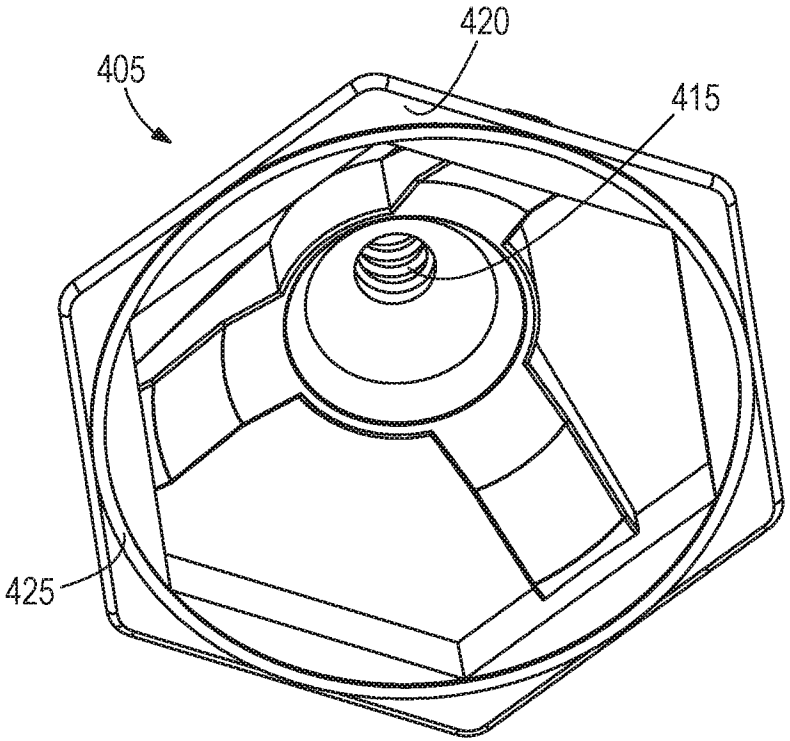
FIG. 4B is a bottom perspective view of the top member of the tile leveling device of FIG. 4A.
Figure 4A:
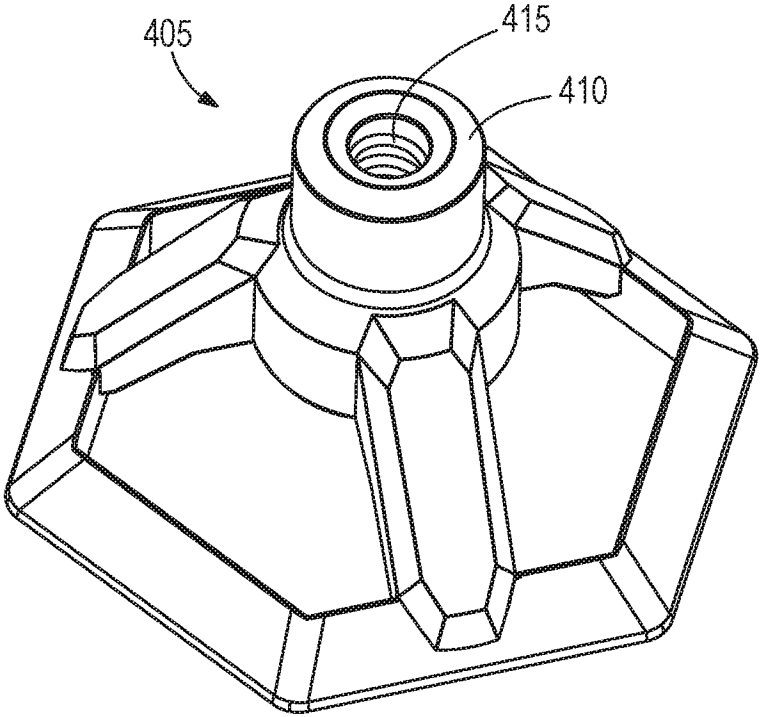
FIG. 4A is a top perspective view of a top member of the tile leveling devices of FIGS. 1A and 1B according to one embodiment of the invention.

FIGS. 4A and 4B illustrate various views of the top member 405 according to one embodiment of the invention. The top member 405 is threadably engaged with the base member 205, 305 to form the tile leveling device 105, 110 that levels and aligns tiles. In some embodiments, the top member 405 is made of plastic that is similar to or different than the plastic of which the base member 205, 305 is made.

As shown in FIGS. 4A and 4B, the top member 405 includes a hub 410 defining a bore and threads 415 on an interior of the hub 410 (i.e., along the bore that may be referred to as a threaded bore). The top member 405 also includes a bottom surface 420 that is configured to contact a top surface of the tiles to be leveled. As shown in FIG. 4B, the bottom surface 420 includes a lip 425 that protrudes from the bottom surface 420 to contact the top surface of the tiles. In other embodiments, the bottom surface 420 may not include the lip 425.

To level and align tiles during tile installation, the base member 205, 305 is inserted underneath a tile that has been laid on wet grout/mortar on a substrate. In other words, an end of the base 210, 310 is inserted underneath a tile such that the tile is flush against the projection 250, 350 and/or the lower portion 230, 330 of the stem 225, 325. After additional grout/mortar is placed on the substrate where additional tiles are to be laid, the edges of the additional tiles are placed on the top surface 215, 315 of the base 210, 310 such that they are also flush against the projection 250, 350 and/or the lower portion 230, 330 of the stem 225, 325 (see FIGS. 2F and 3F). In this situation, the base 210, 310 is located underneath the tiles with the bottom surface 220, 320 of the base 210, 310 contacting the substrate on which the tiles are laid and the top surface 215, 315 of the base 210, 310 contacting the bottom surface of the tiles (see FIGS. 2F and 3F). The stem 225, 325 is located between the edges of adjacent tiles and protrudes perpendicularly upward from the base 210, 310 above the top surface of the tiles (see FIGS. 2F and 3F). In some embodiments, both the upper portion 235, 335 and part of the lower portion 230, 330 extend above the top surface of the tiles (see FIGS. 2F and 3F).

At this point in the tile installation process, the top member 405 is threaded onto the stem 225, 325 (see FIGS. 1A and 1B). In other words, the threads 415 on the interior of the hub 410 threadably couple with the threaded upper portion 235, 335 of the stem 225, 325 to allow the top member 405 to be moved downward toward the top surface of the tiles. When the bottom surface 420 of the top member 405 contacts the top surface of the tiles, the top member 405 may be screwed downward further to provide tile leveling force between the top member 405 and the base 210, 310 located underneath the tiles. The top member 405 is screwed downward as desired to apply a tile leveling force that makes the top surface of adjacent tiles approximately level with each other.

With adjacent tiles level with each other, the grout/mortar is allowed to dry for a period of time to secure the tiles in place. After the grout/mortar has dried, a force is applied to the stem 225, 325 (for example, a user may kick the stem 225, 325 or hit the stem 225, 325 with a rubber mallet) to remove the stem 225, 325 from the base 210, 310. As mentioned above, the weakened portions 240, 340 of the lower portion 230, 330 of the stem 225, 325 allow the stem 225, 325 to be removed from the base 210, 310 when a proper amount of force is applied to the stem 225, 325. In some situations, the stem 225, 325 is removed from the base 210, 310 while the top member 405 is still screwed onto the stem 225, 325. In such situations, the top member 405 may be unscrewed and removed from the stem 225, 325 after the stem 225, 325 is removed, and the top member 405 may be reused on a different base member 205, 305 to level additional tiles. In other situations, the top member 405 is unscrewed and removed from the stem 225, 325 before the stem 225, 325 is removed from the base 210, 310. As mentioned above, the base 210, 310 remains underneath the tiles after the stem 225, 325 is removed.

Numerous designs for the top member 405 are possible as long as the top member 405 is configured to threadably couple with the base member 205, 305 to apply a tile leveling force to the top surface of the tiles. For example, FIGS. 5A-13B illustrate additional embodiments of a top member that is configured to threadably couple with the base member 205, 305 to form a tile leveling device that levels and aligns tiles. The top members shown in FIGS. 5A-13B are similar to the top member 405 described above, and common elements have the same reference plus "100" for each different embodiment. The above explanation of the elements of the top member 405 and its interaction with the base member 205, 305 applies to the common elements of the top members of the embodiments shown in FIGS. 5A-13B unless otherwise noted.

Figure 5B:
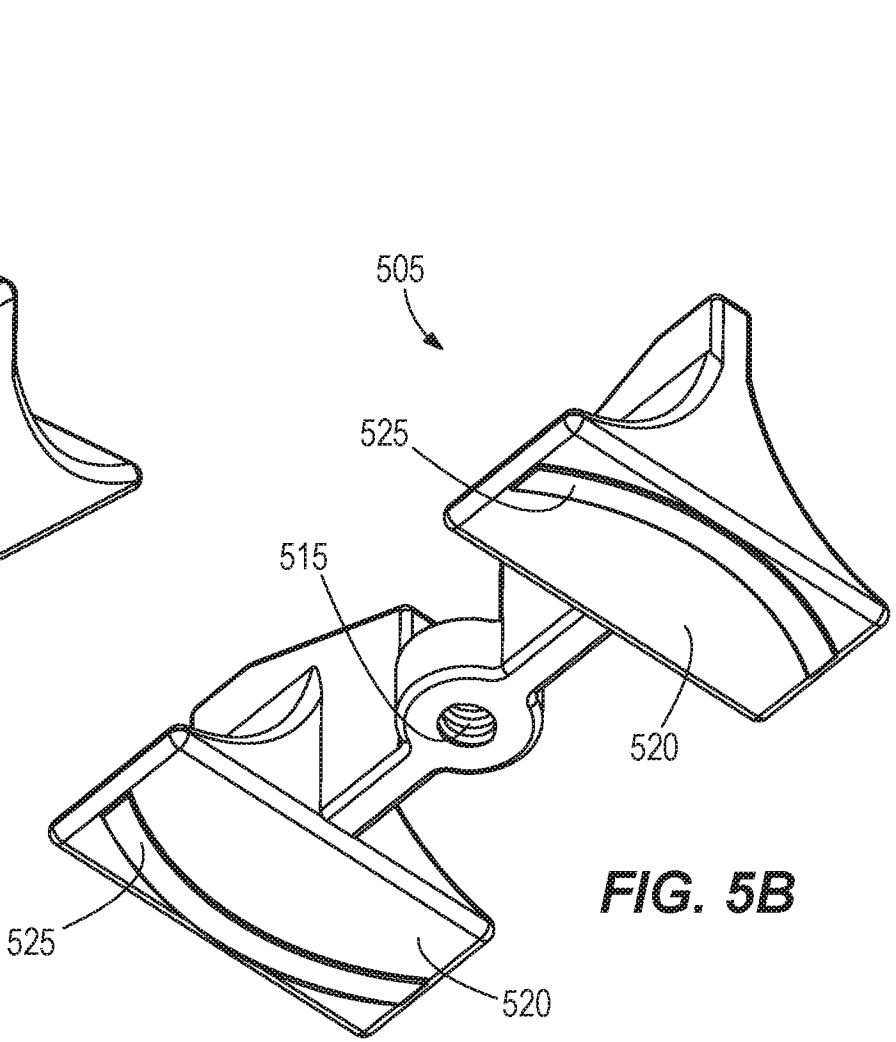
FIG. 5B is a bottom perspective view of the top member of the tile leveling device of FIG. 5A.
Figure 5A:
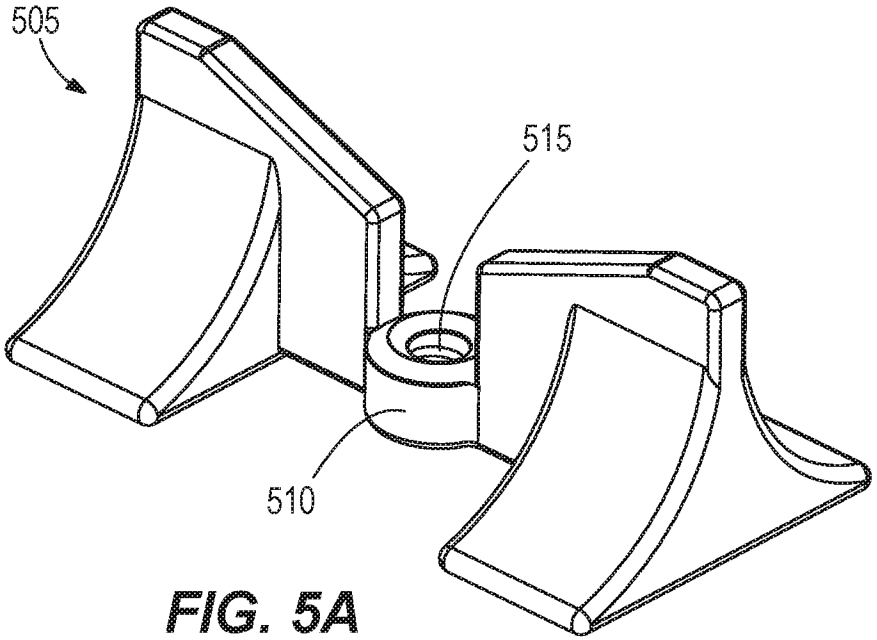
FIG. 5A is a top perspective view of a top member of a tile leveling device according to another embodiment of the invention.

FIGS. 5A and 5B illustrate various views of a top member 505 according to one embodiment of the invention. As shown in FIGS. 5A and 5B, the top member 505 includes a hub 510 defining a bore and threads 515 on an interior of the hub 510 (i.e., along the bore that may be referred to as a threaded bore). The top member 505 also includes a bottom surface 520 that is configured to contact a top surface of the tiles to be leveled. As shown in FIG. 5B, the bottom surface 520 includes a lip 525 that protrudes from the bottom surface 520 to contact the top surface of the tiles. In other embodiments, the bottom surface 520 may not include the lip 525.

Figure 6B:
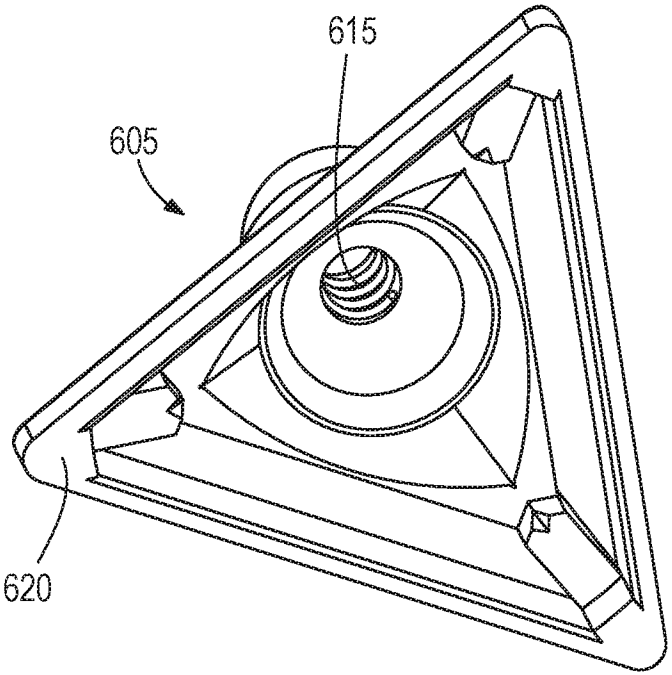
FIG. 6B is a bottom perspective view of the top member of the tile leveling device of FIG. 6A.
Figure 6A:
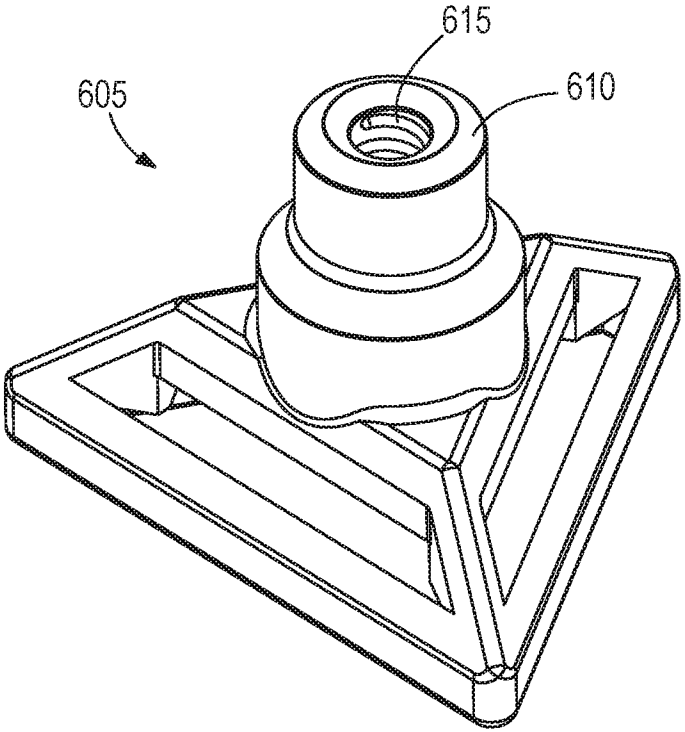
FIG. 6A is a top perspective view of a top member of a tile leveling device according to another embodiment of the invention.

FIGS. 6A and 6B illustrate various views of a top member 605 according to one embodiment of the invention. As shown in FIGS. 6A and 6B, the top member 605 includes a hub 610 defining a bore and threads 615 on an interior of the hub 610 (i.e., along the bore that may be referred to as a threaded bore). The top member 605 also includes a bottom surface 620 that is configured to contact a top surface of the tiles to be leveled.

Figure 7B:
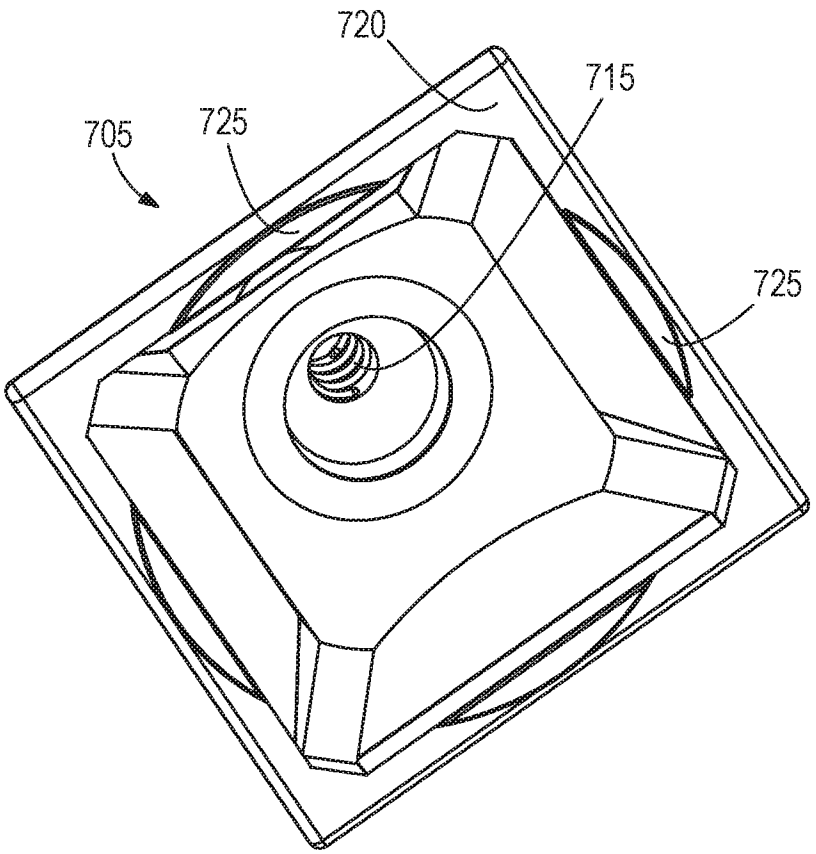
FIG. 7B is a bottom perspective view of the top member of the tile leveling device of FIG. 7A.
Figure 7A:
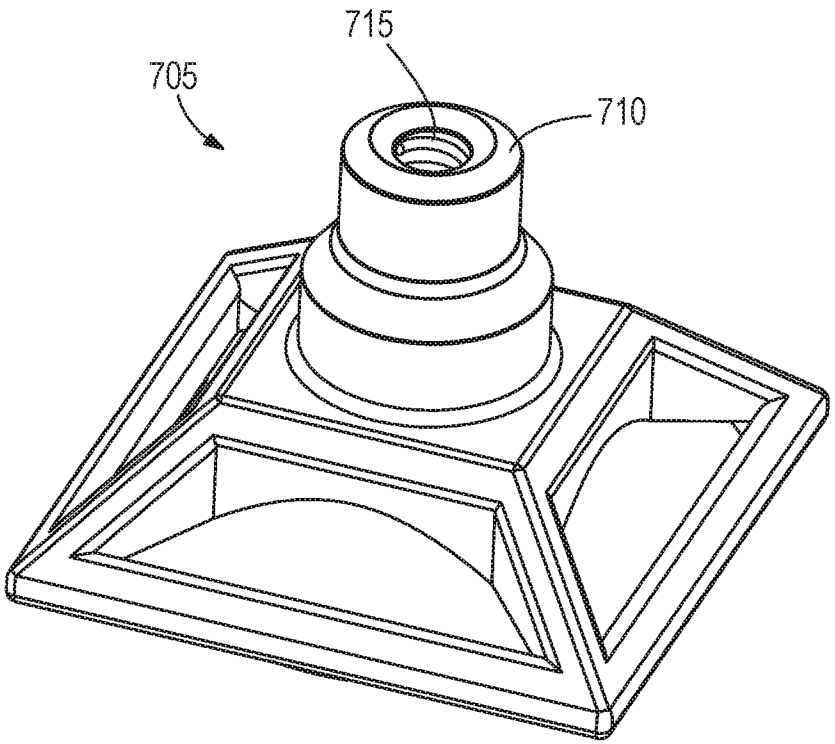
FIG. 7A is a top perspective view of a top member of a tile leveling device according to another embodiment of the invention.

FIGS. 7A and 7B illustrate various views of a top member 705 according to one embodiment of the invention. As shown in FIGS. 7A and 7B, the top member 705 includes a hub 710 defining a bore and threads 715 on an interior of the hub 710 (i.e., along the bore that may be referred to as a threaded bore). The top member 705 also includes a bottom surface 720 that is configured to contact a top surface of the tiles to be leveled. As shown in FIG. 7B, the bottom surface 720 includes a lip 725 that protrudes from the bottom surface 720 to contact the top surface of the tiles. In other embodiments, the bottom surface 720 may not include the lip 725.

Figure 8B:
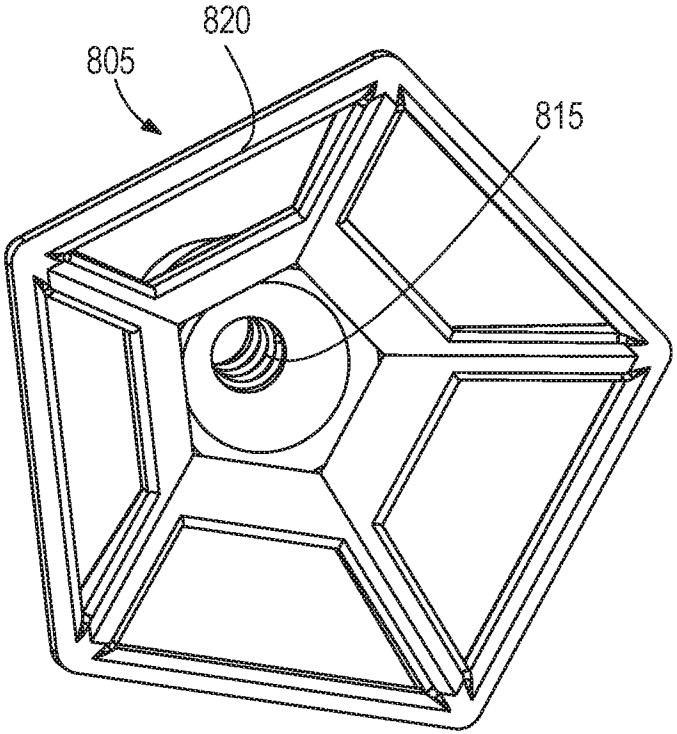
FIG. 8B is a bottom perspective view of the top member of the tile leveling device of FIG. 8A.
Figure 8A:
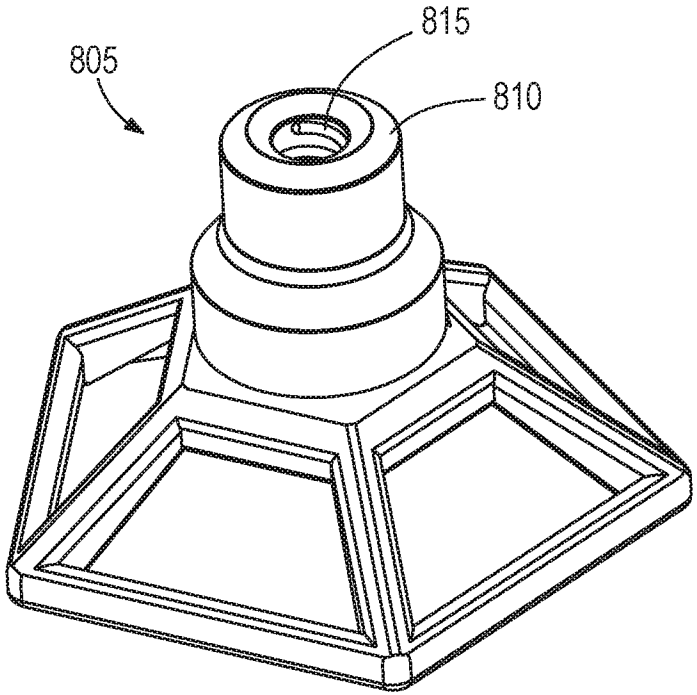
FIG. 8A is a top perspective view of a top member of a tile leveling device according to another embodiment of the invention.

FIGS. 8A and 8B illustrate various views of a top member 805 according to one embodiment of the invention. As shown in FIGS. 8A and 8B, the top member 805 includes a hub 810 defining a bore and threads 815 on an interior of the hub 810 (i.e., along the bore that may be referred to as a threaded bore). The top member 805 also includes a bottom surface 820 that is configured to contact a top surface of the tiles to be leveled.

Figure 9B:
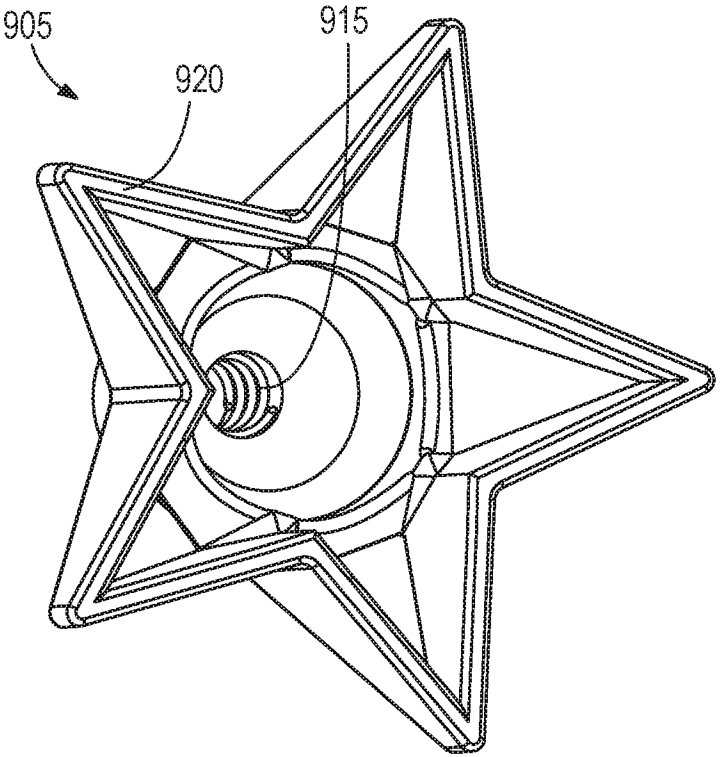
FIG. 9B is a bottom perspective view of the top member of a tile leveling device of FIG. 9A.
Figure 9A:
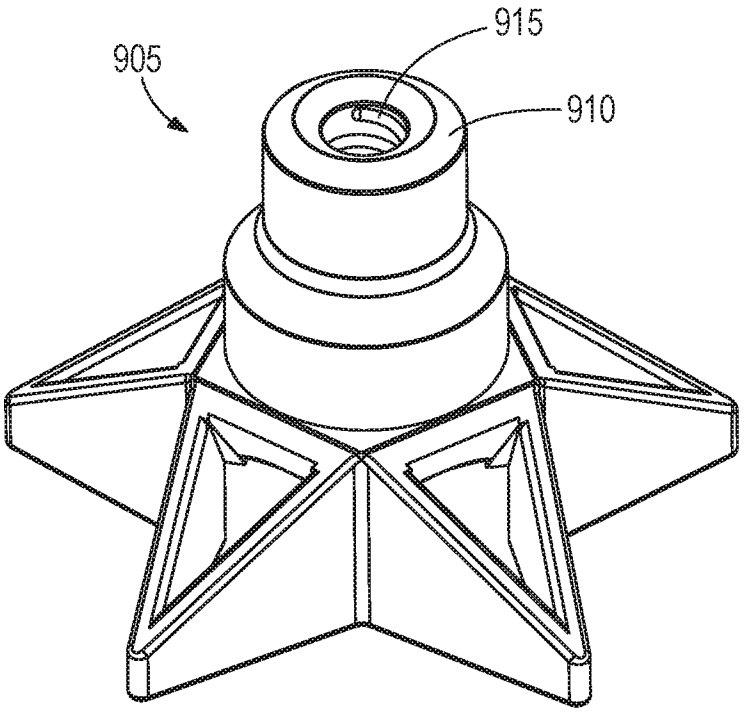
FIG. 9A is a top perspective view of a top member of the tile leveling device according to another embodiment of the invention.

FIGS. 9A and 9B illustrate various views of a top member 905 according to one embodiment of the invention. As shown in FIGS. 9A and 9B, the top member 905 includes a hub 910 defining a bore and threads 915 on an interior of the hub 910 (i.e., along the bore that may be referred to as a threaded bore). The top member 905 also includes a bottom surface 920 that is configured to contact a top surface of the tiles to be leveled.

Figure 10B:
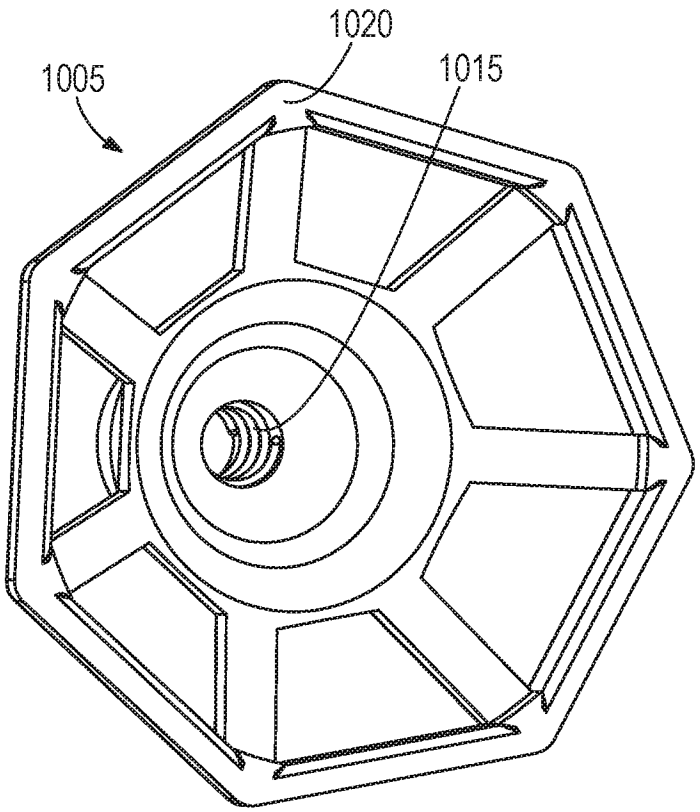
FIG. 10B is a bottom perspective view of the top member of the tile leveling device of FIG. 10A.
Figure 10A:
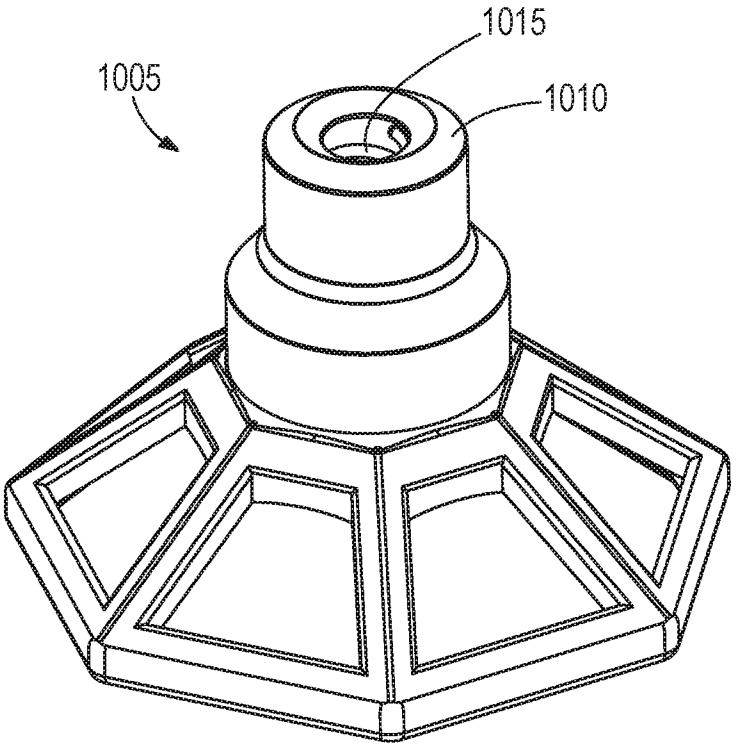
FIG. 10A is a top perspective view of a top member of a tile leveling device according to another embodiment of the invention.

FIGS. 10A and 10B illustrate various views of a top member 1005 according to one embodiment of the invention. As shown in FIGS. 10A and 10B, the top member 1005 includes a hub 1010 defining a bore and threads 1015 on an interior of the hub 1010 (i.e., along the bore that may be referred to as a threaded bore). The top member 1005 also includes a bottom surface 1020 that is configured to contact a top surface of the tiles to be leveled.

Figure 11B:
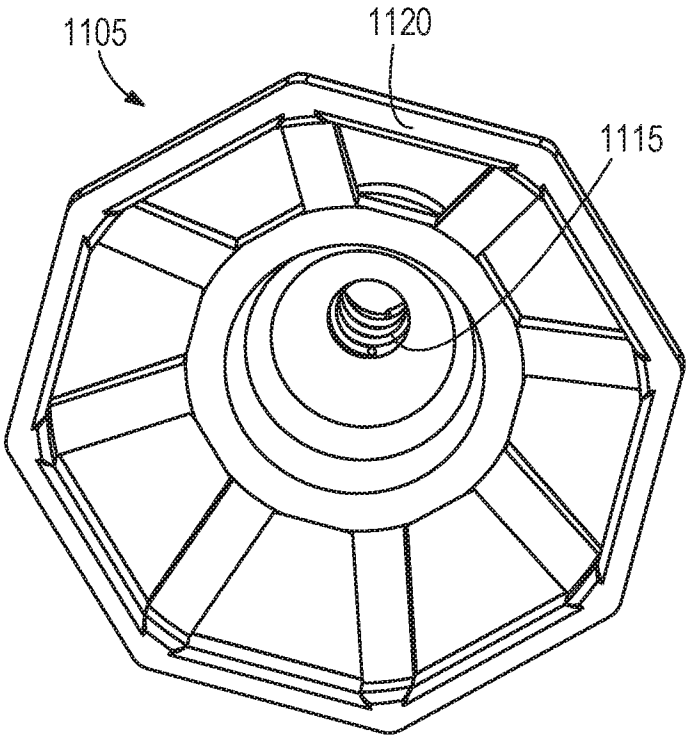
FIG. 11B is a bottom perspective view of the top member of the tile leveling device of FIG. 11A.
Figure 11A:
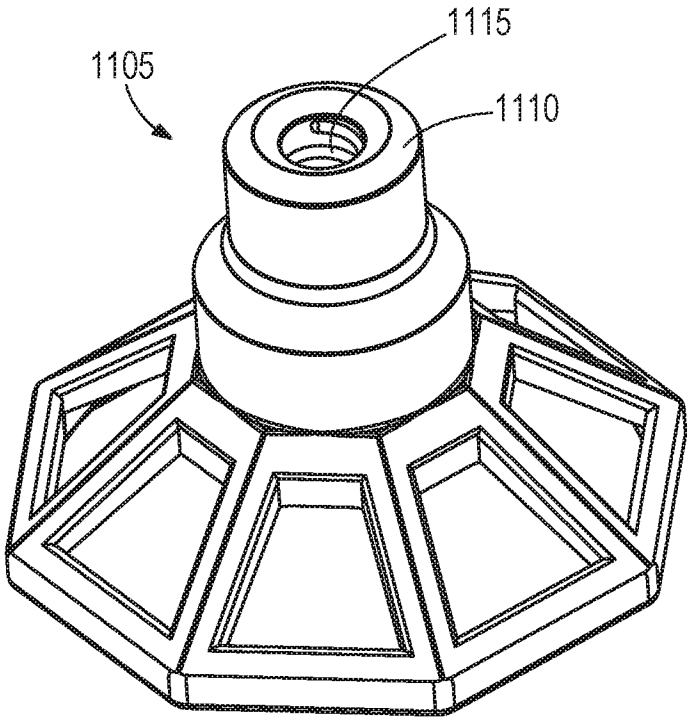
FIG. 11A is a top perspective view of a top member of a tile leveling device according to another embodiment of the invention.

FIGS. 11A and 11B illustrate various views of a top member 1105 according to one embodiment of the invention. As shown in FIGS. 11A and 11B, the top member 1105 includes a hub 1110 defining a bore and threads 1115 on an interior of the hub 1110 (i.e., along the bore that may be referred to as a threaded bore). The top member 1105 also includes a bottom surface 1120 that is configured to contact a top surface of the tiles to be leveled.

Figure 12B:
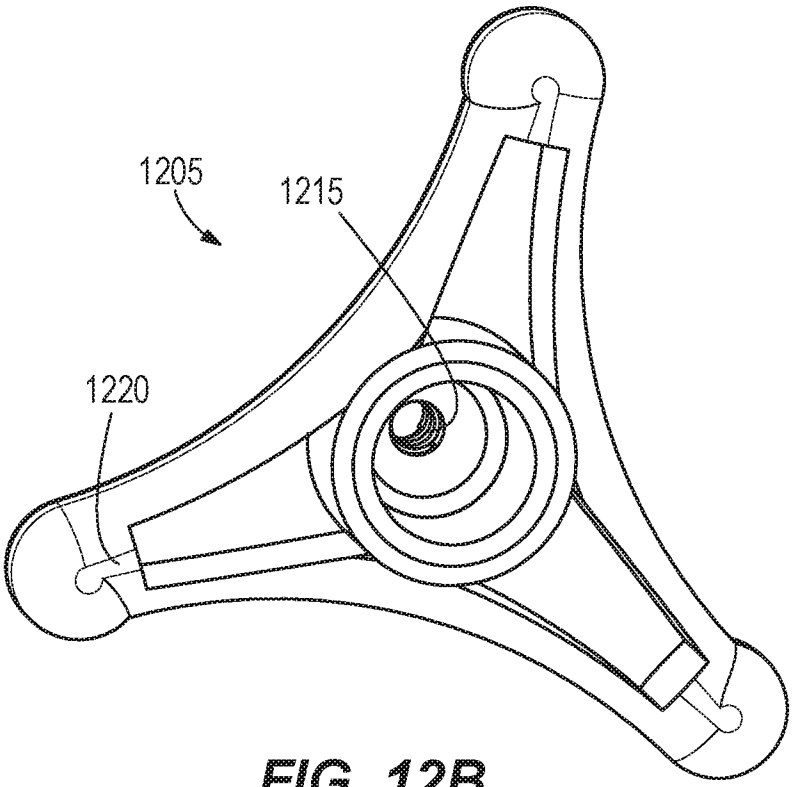
FIG. 12B is a bottom perspective view of the top member of the tile leveling device of FIG. 12A.
Figure 12A:
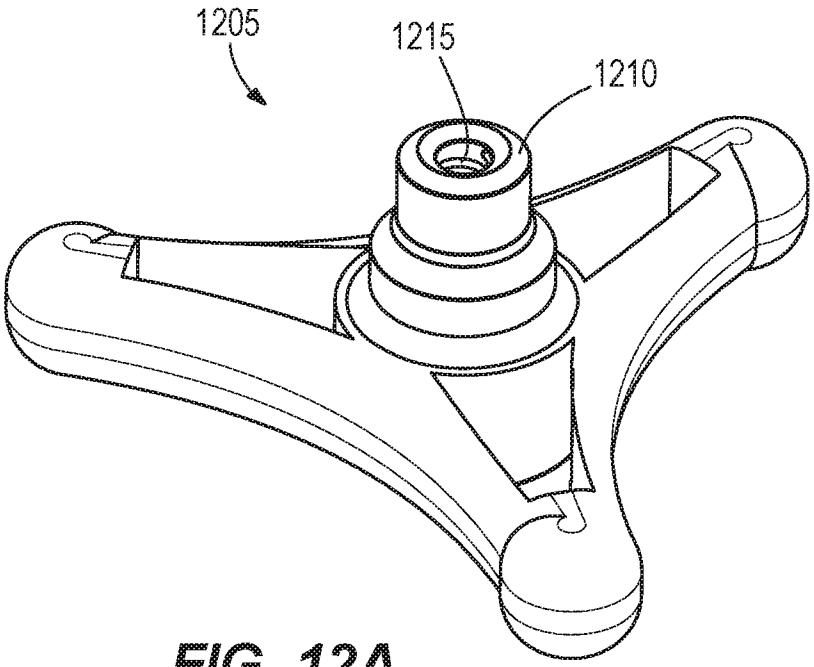
FIG. 12A is a top perspective view of a top member of a tile leveling device according to another embodiment of the invention.

FIGS. 12A and 12B illustrate various views of a top member 1205 according to one embodiment of the invention. As shown in FIGS. 12A and 12B, the top member 1205 includes a hub 1210 defining a bore and threads 1215 on an interior of the hub 1210 (i.e., along the bore that may be referred to as a threaded bore). The top member 1205 also includes a bottom surface 1220 that is configured to contact a top surface of the tiles to be leveled.

Figure 13B:
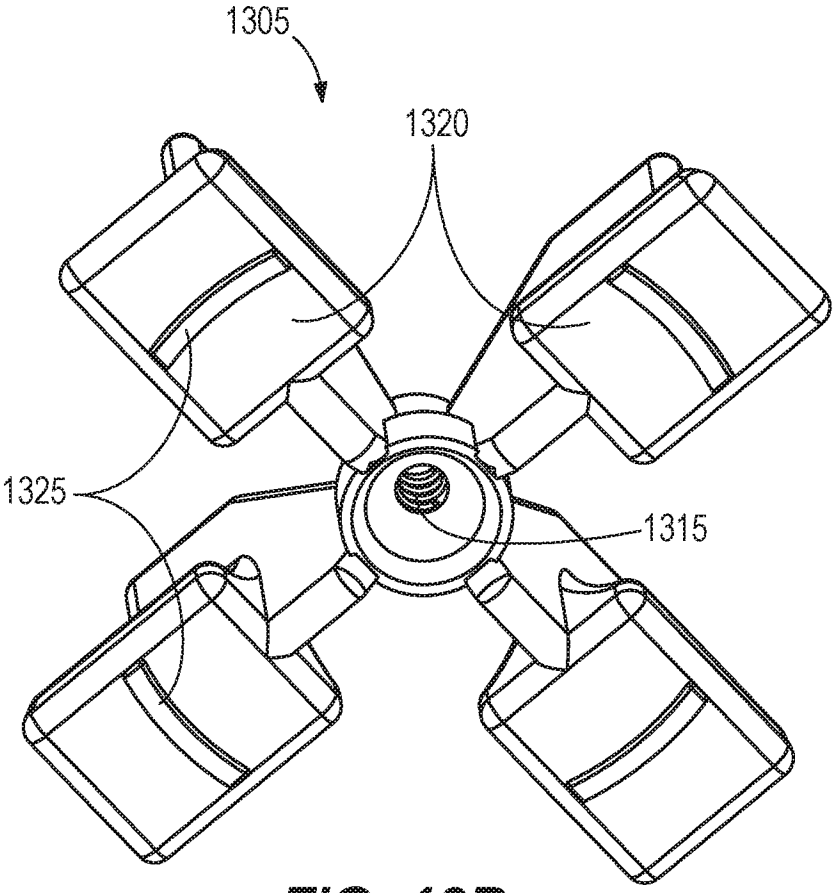
FIG. 13B is a bottom perspective view of the top member of the tile leveling device of FIG. 13A.
Figure 13A:
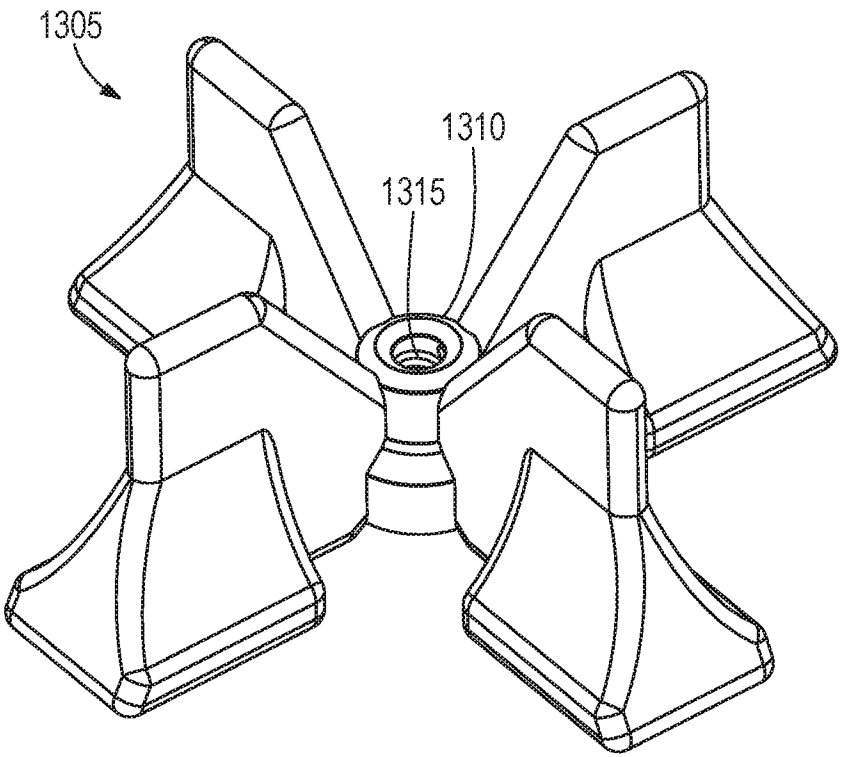
FIG. 13A is a top perspective view of a top member of a tile leveling device according to another embodiment of the invention.

FIGS. 13A and 13B illustrate various views of a top member 1305 according to one embodiment of the invention. As shown in FIGS. 13A and 13B, the top member 1305 includes a hub 1310 defining a bore and threads 1315 on an interior of the hub 1310 (i.e., along the bore that may be referred to as a threaded bore). The top member 1305 also includes a bottom surface 1320 that is configured to contact a top surface of the tiles to be leveled. As shown in FIG. 13B, the bottom surface 1320 includes a lip 1325 that protrudes from the bottom surface 1320 to contact the top surface of the tiles. In other embodiments, the bottom surface 1320 may not include the lip 1325.

Although the invention has been described in detail with reference to certain preferred embodiments, variations and modifications exist within the scope and spirit of one or more independent aspects of the invention as described.

I claim:

1. A tile leveling device comprising:

a base having a top surface and a bottom surface, wherein the base includes a projection extending upwardly from the top surface, the projection including a top side opposite the top surface of the base; and a stem detachably coupled to the top surface of the base, the stem including a lower portion and an upper portion having a threaded portion, wherein the lower portion is wider than the upper portion, wherein the stem includes an opening located at a center of the lower portion of the stem, wherein the opening extends from the top surface of the base and terminates at an upper end, and wherein a portion of the projection is positioned within the opening such that the top side of the projection is spaced from the upper end of the opening.

2. The tile leveling device of claim 1, wherein the projection passes through the opening.

3. The tile leveling device of claim 1, wherein the base includes a first cutout at a first end of the base with respect to the stem and a second cutout at a second end of the base with respect to the stem.

4. The tile leveling device of claim 3, wherein the base has a first thickness at a middle portion of the base where the stem is located and a second thickness at outer portions of the base where the first cutout and the second cutout are located, and the first thickness is greater than the second thickness.

5. The tile leveling device of claim 3, wherein the first cutout and the second cutout are triangularly-shaped.

6. The tile leveling device of claim 1, wherein the threaded portion of the upper portion of the stem interacts with a top member that is received by the upper portion.

7. The tile leveling device of claim 6, further comprising the top member, the top member including:

a hub defining a threaded bore; and a second bottom surface.

8. The tile leveling device of claim 1, wherein the lower portion of the stem includes a weakened portion at an intersection of the stem and the base.

9. The tile leveling device of claim 1, wherein the projection and the lower portion of the stem maintain spacing between tiles placed on the top surface of the base.

10. A tile leveling device including a base member and a top member, the base member comprising:

a base having a top surface, a bottom surface, a first end, a second end and a projection extending from the top surface, wherein the bottom surface contacts a substrate during use and the top surface is configured to support at least one tile during use; and a stem detachably coupled to the top surface of the base, the stem including a lower portion and an upper portion, wherein the lower portion of the stem has a width greater than the upper portion of the stem, wherein the upper portion of the stem includes a threaded portion to receive the top member, wherein the stem includes an opening positioned at a center of the lower portion of the stem, wherein a longitudinal axis passes through the first end of the base, the opening, and the second end of the base, and the projection is positioned along the longitudinal axis substantially perpendicular to the lower portion of the stem;

further wherein the base has a variable thickness, with the thickness greater at a central portion of the base and the thickness lesser at the first and second ends of the base, wherein at least a portion of the projection is positioned within the opening, and wherein a gap is defined between the projection and the lower portion of the stem.

11. The tile leveling device of claim 10, wherein the base includes a first cutout at the first end of the base with respect to the stem and a second cutout at the second end of the base with respect to the stem.

12. The tile leveling device of claim 11, wherein the longitudinal axis passes through the first cutout and the second cutout.

13. The tile leveling device of claim 11, wherein the first cutout and the second cutouts are triangularly-shaped.

14. The tile leveling device of claim 10, wherein the top member comprises:

a hub defining a threaded bore; and a second bottom surface.

15. The tile leveling device of claim 10, wherein the lower portion of the stem includes a weakened portion at an intersection of the stem and the base.

16. The tile leveling device of claim 10, wherein the base is elongated along the longitudinal axis.

17. A tile leveling device comprising:

a base member including a base having a first end, a second end opposite the first end, a top surface, and a bottom surface, wherein the base includes a projection extending upwardly from the top surface, the projection configured to maintain a spacing between tiles set upon the top surface of the base; and a stem detachably coupled to the top surface of the base, the stem including a lower portion and an upper portion, wherein the lower portion is wider than the upper portion, wherein the upper portion of the stem includes a threaded portion that defines a major diameter of the upper portion, wherein the stem includes an opening located at a center of the lower portion of the stem, wherein a longitudinal axis passes through the first end of the base, the opening, and the second end of the base, wherein the projection is elongated in a direction substantially perpendicular to the lower portion of the stem, wherein a portion of the projection is positioned within the opening, and wherein the projection extends along the longitudinal axis a length greater than the major diameter of the upper portion; and a top member including a hub defining a threaded bore that threadably couples with the upper portion of the stem, and a second bottom surface.

18. The tile leveling device of claim 17, wherein the projection passes through the opening.

* * * * *